US010450787B1

(12) United States Patent
Jaffee et al.

(10) Patent No.: US 10,450,787 B1
(45) Date of Patent: Oct. 22, 2019

(54) DEVICE FOR PROTECTING FINGERS FROM DOORWAY INJURIES

(71) Applicants: Thomas Jaffee, Boca Raton, FL (US); Martin Hill, Wellington, FL (US)

(72) Inventors: Thomas Jaffee, Boca Raton, FL (US); Martin Hill, Wellington, FL (US)

( * ) Notice: Subject to any disclaimer, the term of this patent is extended or adjusted under 35 U.S.C. 154(b) by 0 days.

(21) Appl. No.: 16/041,220

(22) Filed: Jul. 20, 2018

(51) Int. Cl.
*E05F 5/04* (2006.01)

(52) U.S. Cl.
CPC ..... *E05F 5/04* (2013.01); *E05F 2005/046* (2013.01)

(58) Field of Classification Search
CPC ..... E05F 5/04; E05F 5/02; E05F 5/06; E05F 2005/046; Y10T 16/61; Y10T 16/458; Y10T 16/46; E05C 17/54; E05C 17/047; E05Y 2900/132; E05B 1/0053; E05B 1/0061
USPC ..... 16/82, 412, 414; 292/339, 343
See application file for complete search history.

(56) References Cited

U.S. PATENT DOCUMENTS 5,004,279 A * 4/1991 Radcliff ..... E05B 63/18 16/82
5,375,295 A * 12/1994 Woodward ..... E05B 1/0053 16/412
5,501,494 A * 3/1996 Willetts ..... E05C 19/182 292/262
5,652,998 A * 8/1997 McKenzie ..... E05F 5/04 16/83
5,794,871 A * 8/1998 Willetts ..... E05B 13/001 292/288
6,487,751 B2 * 12/2002 Renaud ..... E05B 17/005 16/83
6,751,827 B1 * 6/2004 Fok ..... E05B 1/0053 16/412
7,766,400 B2 * 8/2010 Predebon ..... E05C 17/54 16/82
2007/0119020 A1 * 5/2007 Keating ..... E05C 17/00 16/110.1
2012/0042590 A1 * 2/2012 Ben-David Yosef ..... E05F 5/02 52/204.1
2013/0299272 A1 * 11/2013 Williams ..... E05F 5/04 181/209

FOREIGN PATENT DOCUMENTS

WO WO-2008081429 A2 * 7/2008 ..... E05B 17/005

* cited by examiner

*Primary Examiner* — William L Miller

(57) ABSTRACT

A device for protecting the fingers of a person from getting impinged in between the door and the doorframe during closing of the door by an operator is provided. The device includes a gripping body configured to wrap around the shank of the doorknob, a bumper body attached to the gripping body configured to prevent the closing of the door, a hollow unit positioned between the bumper body and the gripping body, and one or more connecting body to pass through the hollow unit to connect the gripping body with the shank of the doorknob. When the door is opened, the bumper body is positioned between the door and the door frame. In order to close the door, the operator rotates the doorknob normally, which moves the bumper body, away from the leading edge of the door. The process makes an operator cautious while closing the door and thus effectively protects fingers and hands of the person from injuries that may result from a slamming door.

14 Claims, 8 Drawing Sheets

DEVICE FOR PROTECTING FINGERS FROM DOORWAY INJURIES

BACKGROUND OF THE INVENTION

1. Field of the Invention

The present invention generally relates to a device for protecting fingers from doorway injuries, and more particularly relates to a device attached to the shank of the doorknob for protecting fingers from doorway injuries.

2. Description of Related Art

When fingers or hands get caught between a doorframe and a closing door, injury is a common result. According to the Journal of Hand Surgery approximately one in 220 children per year suffers hand injuries. In children aged 4 and younger, three out of four finger amputations resulted from fingers that were caught, jammed or crushed in an opening or closing door. Many devices have been created to avoid such injuries. Some such devices generate a force to slow the door before it closes. These devices tend to be expensive, bulky, and hard to install and require regular maintenance.

Other common devices involve a bumper that wraps around the front edge of the door and prevents the door from being closed. However, these devices are not safe because they must be removed in order to close the door, so they are not engaged the next time the door is opened and closed, until a person manually replaces it, and children are not likely to have the discipline to replace this device each time the door is opened.

Other devices must be mounted to the doorframe, and involve a spring that places an obstacle between the door and doorframe. To close the door, the operators must carefully push the obstacle through the doorframe, which places their fingers in harm's way. Therefore, there is a need for a better device that protects fingers from doorway injuries. Further, the device should allow the door to open and close without any hindrance.

SUMMARY OF THE INVENTION

In accordance with the teachings of the present invention, a device attached to the shank of the doorknob for protecting fingers from doorway injuries is provided.

An object of the present invention is to provide a device attached to the shank of the doorknob for protecting fingers from doorway injuries. The device includes a gripping body configured to wrap around the shank of the doorknob, a bumper body attached to the gripping body configured to prevent the closing of the door, and one or more connecting body to connect the gripping body with the shank of the doorknob. The gripping body is attached to the shank. When the shank of the doorknob rotates, the bumper body also rotates as the operator turns the doorknob.

Thus in order to close the door the operator rotates the doorknob normally, which moves the bumper body away from the leading edge of the door, and while holding the doorknob in the rotated position, the operator may pull or push the door into the closed position. Because the bumper body blocks the space between the door and the doorframe when the doorknob is released, the door will not close unless the doorknob is held in the rotated position while the door is being closed. Therefore, this device effectively protects fingers and hands from injuries that may result from a slamming door.

Another object of the present invention is to provide one or more connecting body having plurality of adhesive unit attached to the sides of gripping body, first Velcro strap attached to one side of the gripping body by at least one of the adhesive units, and a second Velcro strap attached to another side of the gripping body by at least one of the adhesive units. The first Velcro strap wraps around the shank of the doorknob, at which point the hooks of the Velcro connect with the loops of the second Velcro strap in order to fix the gripping body to the shank of the doorknob.

Another object of the present invention is to provide a device with a hollow unit positioned between the bumper body and the gripping body. Further, the one or more connecting body including a third Velcro strap with a loop and a hook unit, the third Velcro strap is inserted through the hollow unit, then wrapped around the shank of the doorknob and further connected around the hook unit of the Velcro strap, resulting in fixation of the gripping body to the shank of the doorknob.

Another object of the present invention is to provide one or more connecting body including a clasp positioned in between the bumper body and the gripping body and a fourth Velcro strap with a loop that inserts around the clasp on one end of the gripping body, then wrapped across the gripping body covering the shank of the doorknob, then inserted under the clasp on the other side of the gripping body and cinched backwards to secure the hook section of the Velcro strap to the loops section in order to fix the position of the gripping body to the shank of the doorknob.

Further features and advantages of the present invention, as well as the structure and operation of various embodiments of the present invention, are described in detail below with reference to the accompanying drawings.

DETAILED DESCRIPTION OF THE DRAWINGS

Figure 1:
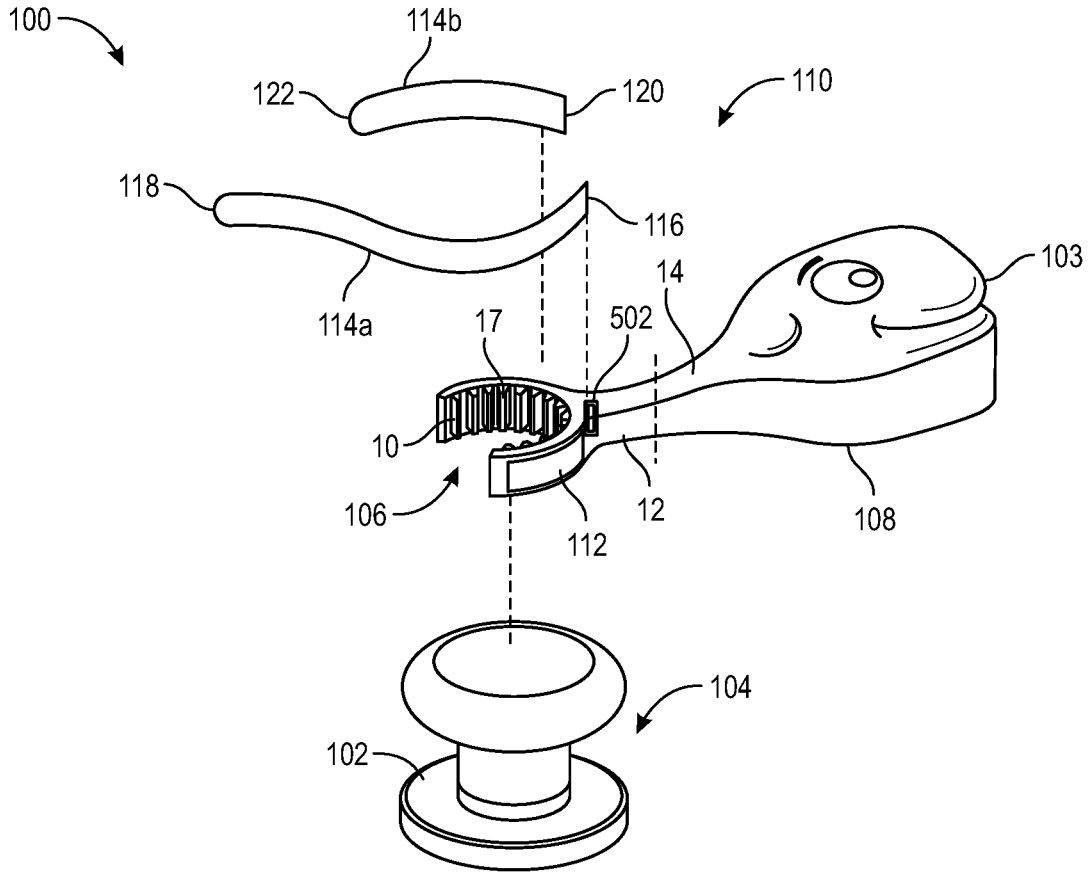
FIG. 1 illustrates an exploded view of the device attached to the shank of the doorknob in accordance with a preferred embodiment of the present invention.

While this technology is illustrated and described in a preferred embodiment, a device attached to the shank of the doorknob for protecting fingers of a person by an operator slamming the door may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction, and is not intended to limit the invention to the embodiment illustrated. Those skilled in the art will envision many other possible variations within the scope of the technology described herein.

An operator is an individual who is opening or dosing the door. A person is another individual whose fingers or hand may come in between the door and the doorframe while the door is being dosed by the operator.

FIG. 1 illustrates an exploded view of the device 100 attached to the shank 102 of the doorknob 104 for protecting fingers of a person from getting impinged in between the door and the doorframe during closing of the door by an operator in accordance with a preferred embodiment of the present invention. The position of the device between the door and the door frame is shown and explained in detail in conjunction with FIG. 2 to FIG. 4 of the present invention.

The device 100 includes a gripping body 106, a bumper body 108, a hollow unit 502 and one or more connecting body 110. The gripping body 106 includes a distal end 10 and a front end 12. The distal end 10 of the gripping body 106 is configured to wrap around the shank 102 of the doorknob 104.

The bumper body 108 includes a rear end 14 and a bumper end 103. The rear end 14 is attached to the front end 12 of the gripping body 106. The bumper end 103 is configured to prevent the closing of the door. The hollow unit 502 is configured on the gripping body 106 for allowing the connecting body 110 to pass through and secure the gripping body 106 on the shank 104 to desired tightness.

The one or more connecting body 110 connect the gripping body 106 with the shank 102 of the doorknob 104. The gripping body 106 and the bumper body 108 are rotated by the rotation of shank 102 of the doorknob 104 by the operator. In order to close the door, the operator rotates the bumper body 108, positioned in between the door and the doorframe, away from the leading edge (109, shown in FIG. 2) of the door, and holds the doorknob 104 in the rotated position until the door is closed, thereby protecting the fingers of the person from a slamming door.

In a preferred embodiment of the present invention, the gripping body 106 is C shaped or convex shaped for configuring to wrap around the shank 102 of the doorknob 104. The bumper body 108 is an elongated tube which broadens at the bumper end 103.

Examples of the shape of the bumper body 108 include but not limited to a whale, baseball bat, bowling pin, football, oar, flower, etc. However, it will be readily apparent to those skilled in the art that various other shapes of the bumper body 108 and the gripping body 106 may be envisioned without deviating from the scope of the present invention.

Slamming the door without holding the doorknob 104 and without the bumper body 108 in place between the door and the doorframe increases the probability of the person's fingers getting impinged in between the door and the doorframe. However, with the bumper body 108 in place, the door is not able to close. To close the door, the operator must rotate the doorknob 104, which causes the bumper body 108 to rotate with the shank 102, which moves the bumper body 108 away from the leading edge (109, shown in FIG. 2) of the door.

Closing the door becomes a deliberate act, and thus the person's fingers are protected from getting impinged in between the door and the doorframe. The deliberate act would be to rotate the bumper body 108 away from the door frame and holding the doorknob 104 in the rotated position while closing the door, thus reducing the chance of closing the door on the person's fingers. The process of operating the device 100 is shown and explained in detail in conjunction with FIG. 2 to FIG. 4 of the present invention.

The one or more connecting body 110 passes through the hollow unit 502 for fixing the gripping body 106 around the shank 102 of the doorknob 104. The examples of one or more connecting body 110 include but not limited to a tight-fitting gripping body, a self-locking zip tie, a Velcro strap, a zip tie, a clamp, a buckle, a clamp, an adhesive tape, etc.

In a preferred embodiment of the present invention, the one or more connecting body 110 includes a plurality of adhesive unit 112, first Velcro strap 114*a* and the second Velcro strap 114*b*. The adhesive unit 112 is attached to the outside of the gripping body 106. Examples of attachment of the adhesive unit 112 to the gripping body 106 include but not limited to glue, rivet or the like, etc.

The first Velcro strap 114*a* is having a first front end 116 and a first back end 118. The second Velcro strap 114*b* is having a second front end 120 and a second back end 122. The first front end 116 and the second front end 120 are attached to the adhesive unit 112 on both sides of the gripping body 106 respectively, and the first back end 118 is secured to the second back end 122 as they are wrapped around the shank 102 of the doorknob 104.

In another preferred embodiment of the present invention, the device 100 includes a second adhesive 17 attached on the inside portion of the distal end 10 of the gripping body 106 that wraps around the shank 102. The adhesive unit 17 is permanently connected to the inside surface of the gripping body 106. The outside surface of the adhesive unit 17 providing a tacky surface that in conjunction with the connecting body 110 prevents the gripping body 106 from slipping about the shank 102.

In another preferred embodiment of the present invention, the rear end 14 of the bumper body 108 is configured to detachably attach with the front end 12 of the gripping body 106. When the door is closed, the bumper body 108 bends against the door frame to allow the door knob 104 to return to a neutral position allowing the door to latch. The neutral position is shown and explained in detail in conjunction with FIG. 3 of the present invention.

Figure 2:
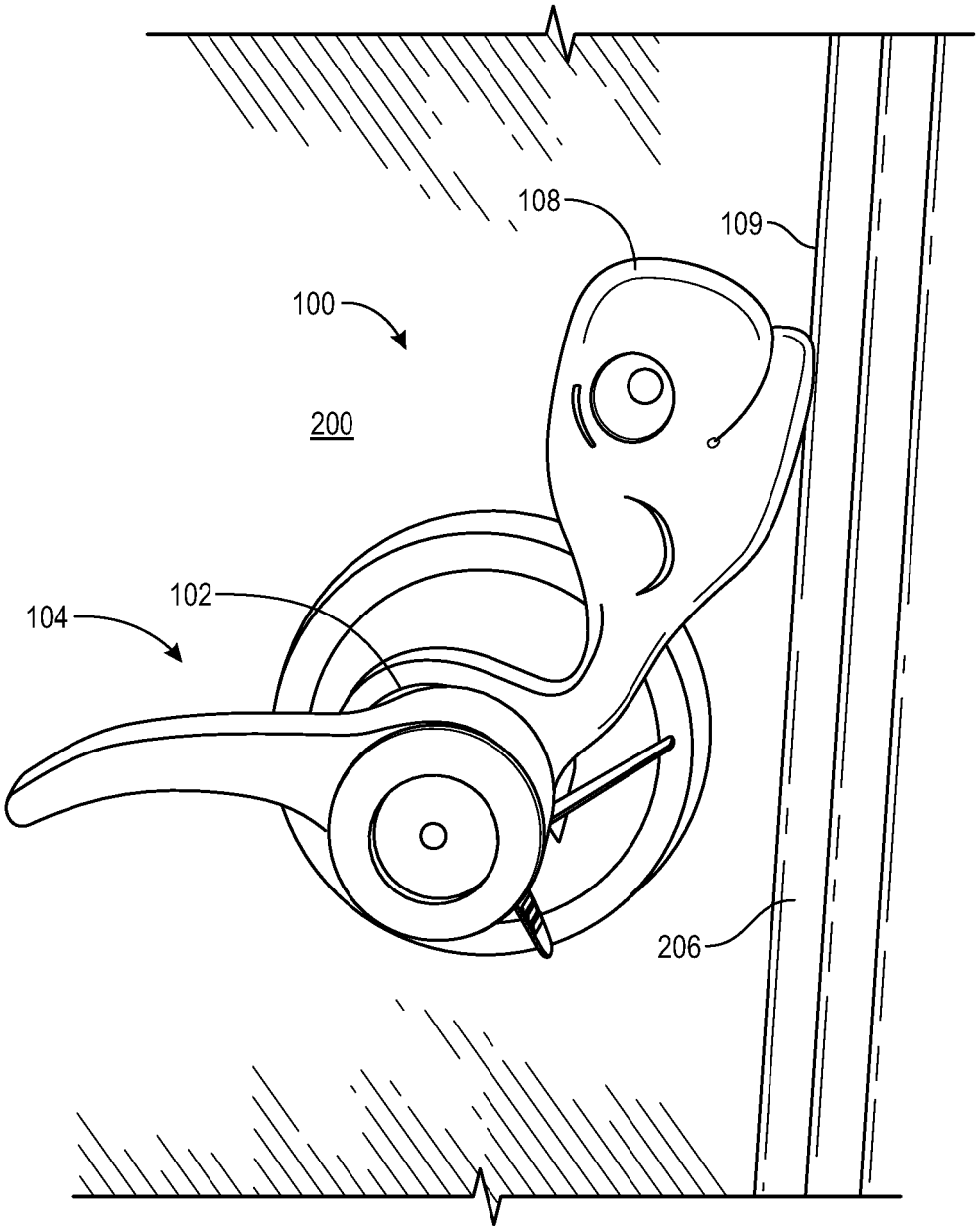
FIG. 2 illustrates a perspective view of the device attached to the shank of the doorknob.

FIG. 2 illustrates a perspective view of the device 100 attached to the shank 102 of the doorknob 104. In an exemplary embodiment of the present invention, the door 200 is closed and the device 100 is attached to the shank 102 of the doorknob 104. The bumper body 108 rests on the doorframe 206. In another embodiment, in order to close and latch the door 200, the bumper body 108 bends to allow the doorknob 104 to rotate back to its resting position. Further, in another preferred embodiment of the present invention, the bumper body 108 is made up of a flexible material for allowing bending.

Figure 3:
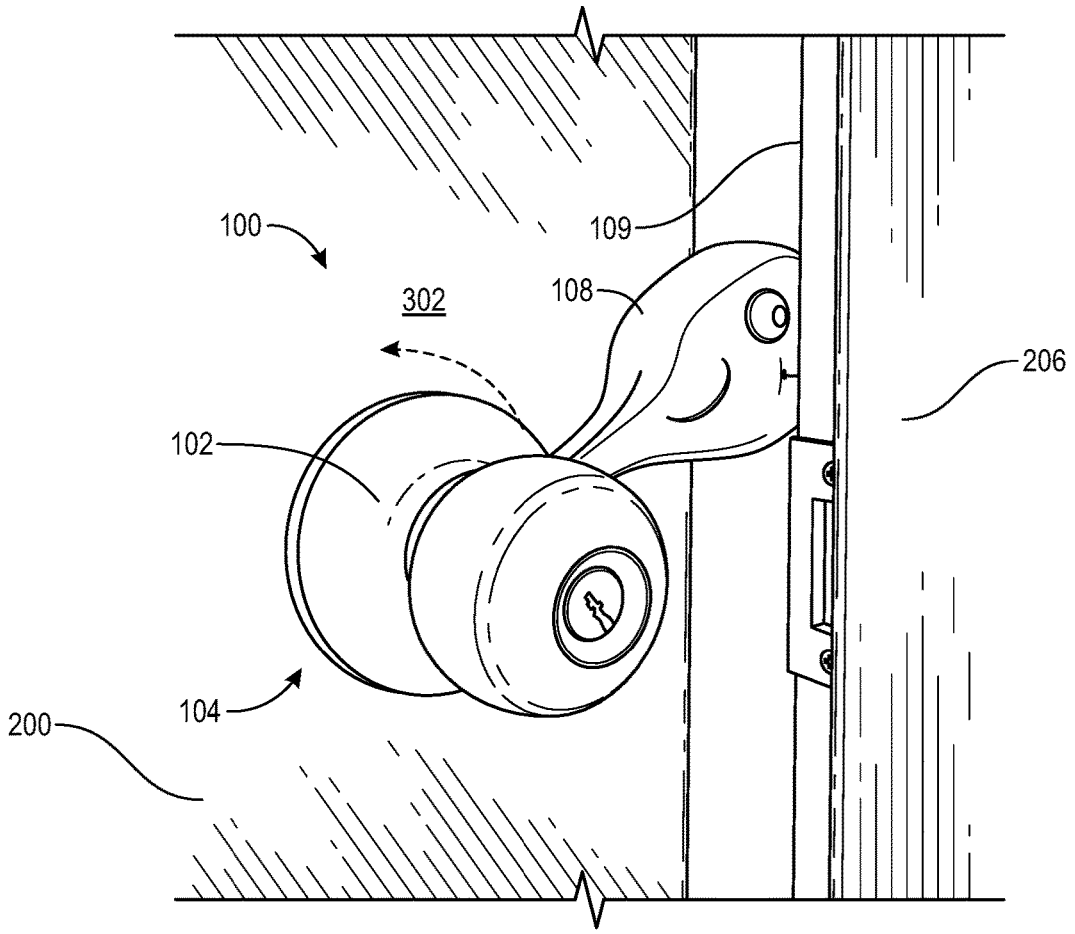
FIG. 3 illustrates a perspective view of the device attached to the shank of the doorknob, positioned to prevent the closing of the door.

FIG. 3 illustrates another perspective view of the device 100 attached to the shank 102 of the doorknob 104 and further positioned to prevent the closing of the door 200. In exemplary embodiment of the present invention, the bumper body 108 is moved away from the leading edge 109 of the door 200 in the direction of the arrow 302 in order to close the door 200.

The bumper body 108 is shown resting in a neutral position. When the door is closed, the bumper body 108 bends so that the door knob 104 returns to its neutral position and allows the door latch to fully close, at which point the bumper body 108 bends against the door frame 206 so that as soon as the door opens, the bumper body 108 springs back into its neutral position.

Thus, as shown in FIG. 3, the door 200 swings toward the doorframe 206 automatically or by force applied by the operator. The bumper body 108 acts as an obstacle between the door 200 and the doorframe 206. Now, in order to close the door 200, the operator needs to rotate the bumper body 108 away from the leading edge 109 of the door 200. The process of rotating the bumper body 108 is explained in detail in conjunction with FIG. 4 of the present invention.

Figure 4:
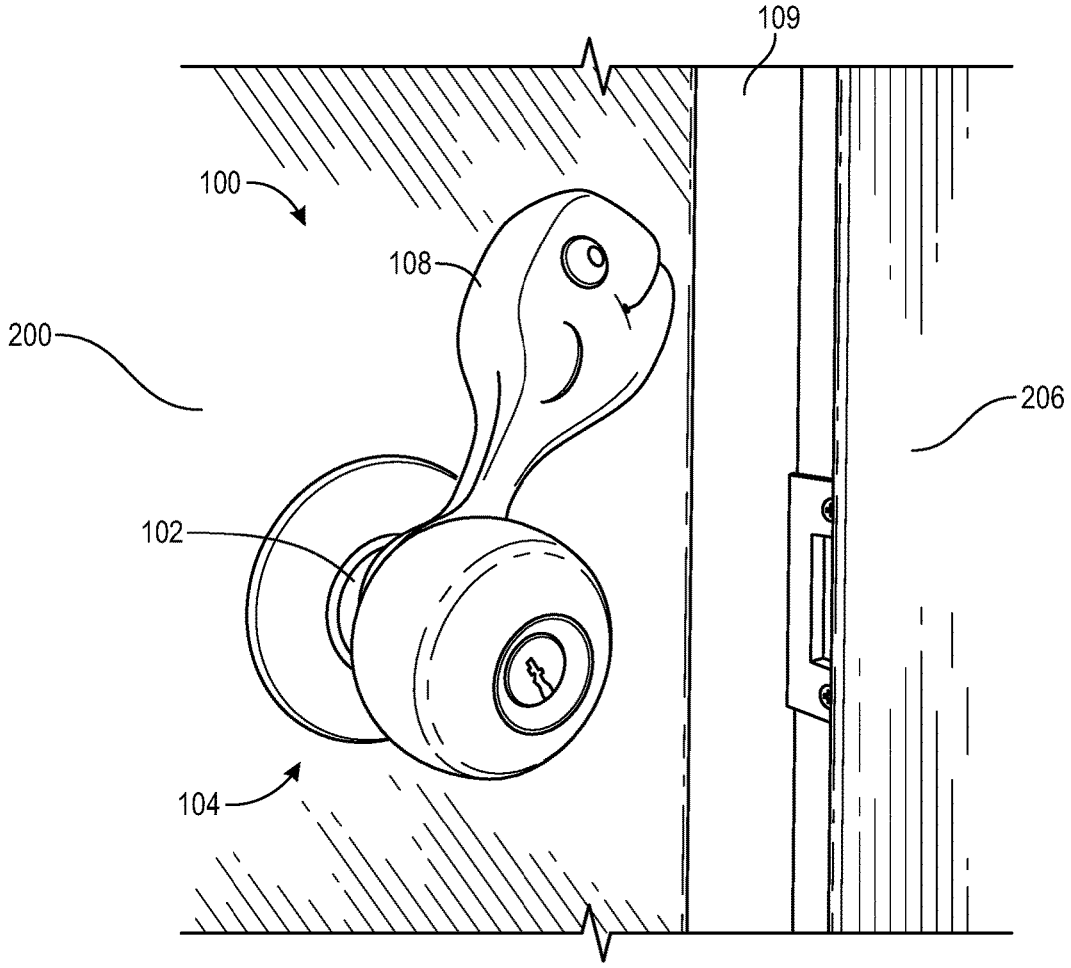
FIG. 4 illustrates another perspective view of the device attached to the shank, and rotated away from the leading edge of the door, in order to close the door.

FIG. 4 illustrates another perspective view of the device 100 attached to the shank 102 of the doorknob 104 in another preferred embodiment of the present invention. In order to close the door 200, the device 100 is rotated away from the leading edge 109 of the door 200 and from the doorframe 206.

The operator deliberately holds the doorknob 104 in the rotated position while closing the door 200, which moves the bumper body 108 away from the leading edge 109 of the door 200. Because the doorknob is being deliberately held while the door 200 is being closed, the fingers of the person are less likely to be impinged in between the door 200 and the doorframe 206.

Figure 5:
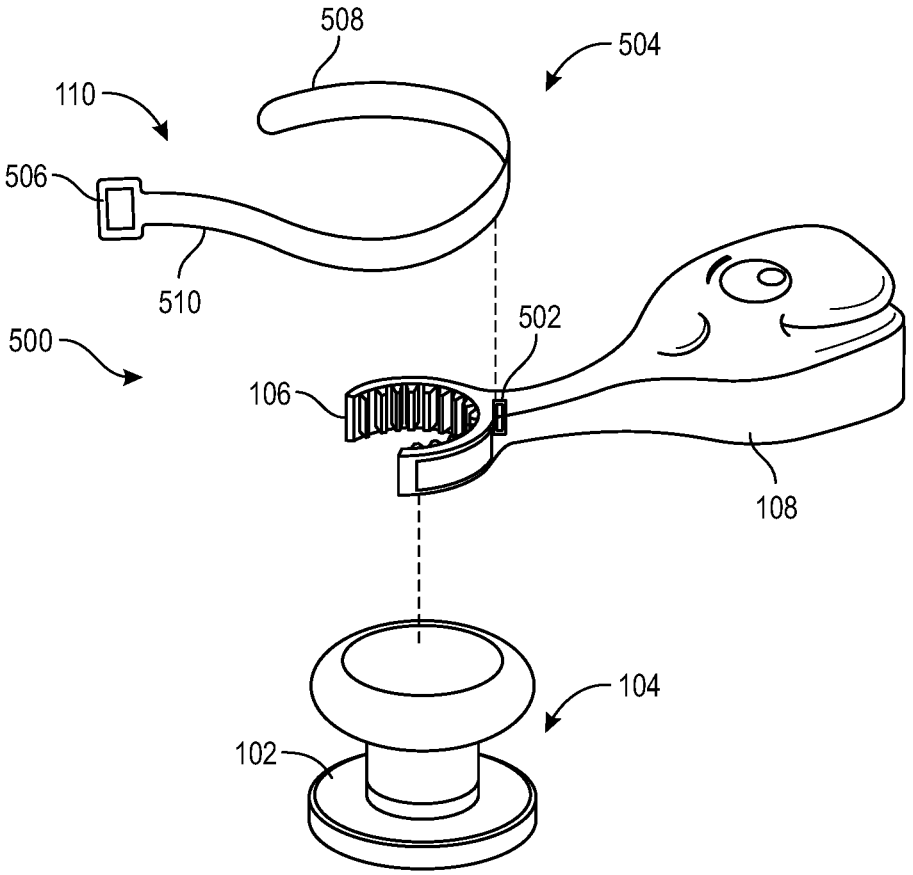
FIG. 5 illustrates another exploded view of the device showing the third Velcro strap in accordance with another preferred embodiment of the present invention.

FIG. 5 illustrates another exploded view of the device 500 in accordance with another preferred embodiment of the present invention. The device 500 further includes a hollow unit 502 configured on the gripping body 106. The hollow unit 502 allows the one or more connecting body 110 to pass through the hollow unit 502 and fix the gripping body 106 to the shank 102 of the doorknob 104.

The one or more connecting body 110 includes a third Velcro strap 504 and a hook unit 506. The third Velcro strap 504 is having a third first end 508 and a third back end 510. The third back end 510 is attached to the hook unit 506. The third first end 508 is inserted through the hollow unit 502 and is wrapped around the gripping body 106 and shank 102 of the doorknob 104.

The third front end 508 is then attached to the hook unit 506 for fixing the gripping body 106 to the shank 102 of the doorknob 104. In a preferred embodiment the third front end 508 is passed through the hole in the hook unit 506, and then is pulled backward to cinch around the gripping body 106 for fixing to the shank 102 of the doorknob 104.

Figure 6:
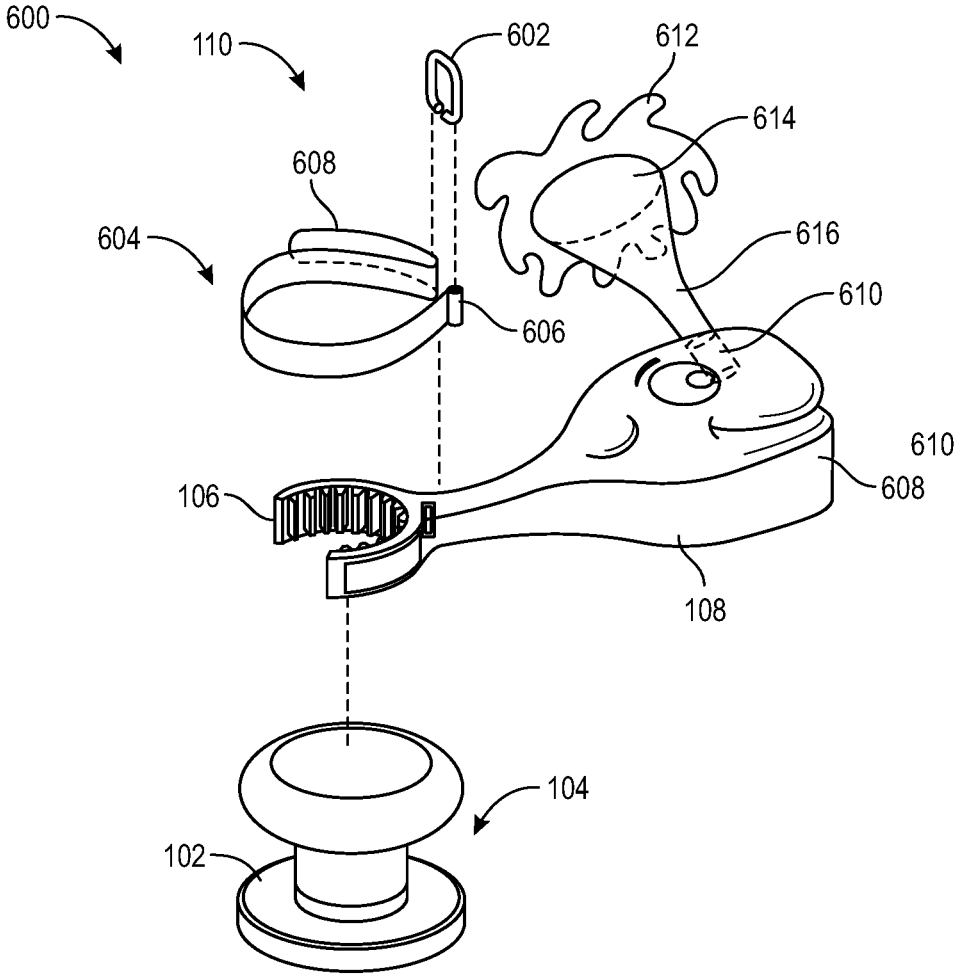
FIG. 6 illustrates another exploded view of the device showing the fourth Velcro strap in accordance with another preferred embodiment of the present invention.

FIG. 6 illustrates another exploded view of the device 600 in accordance with another preferred embodiment of the present invention. The one or more connecting body 110 further includes a clasp 602 positioned in between the bumper body 108 and the gripping body 106, and a fourth Velcro strap 604.

The fourth Velcro strap 604 is having a fourth front end 606 attached to the clasp 602 and a fourth back end 608 rotates around the shank 102 of the doorknob 104 across the gripping body 106 and under the clasp 602, then pulled backwards for fixing the gripping body 106 to the shank 102 of the doorknob 104.

In another preferred embodiment of the present invention, the bumper body 108 includes a receptacle unit 610 and a message holder 612. The receptacle unit 610 is configured in the bumper body 108. The message holder 612 is secured in the receptacle unit 610. The message holder 612 displays a message 614, wherein the message 614 is interchangeable. The message holder 612 includes a stem 616 that is secured in the receptacle unit 610.

Figure 7:
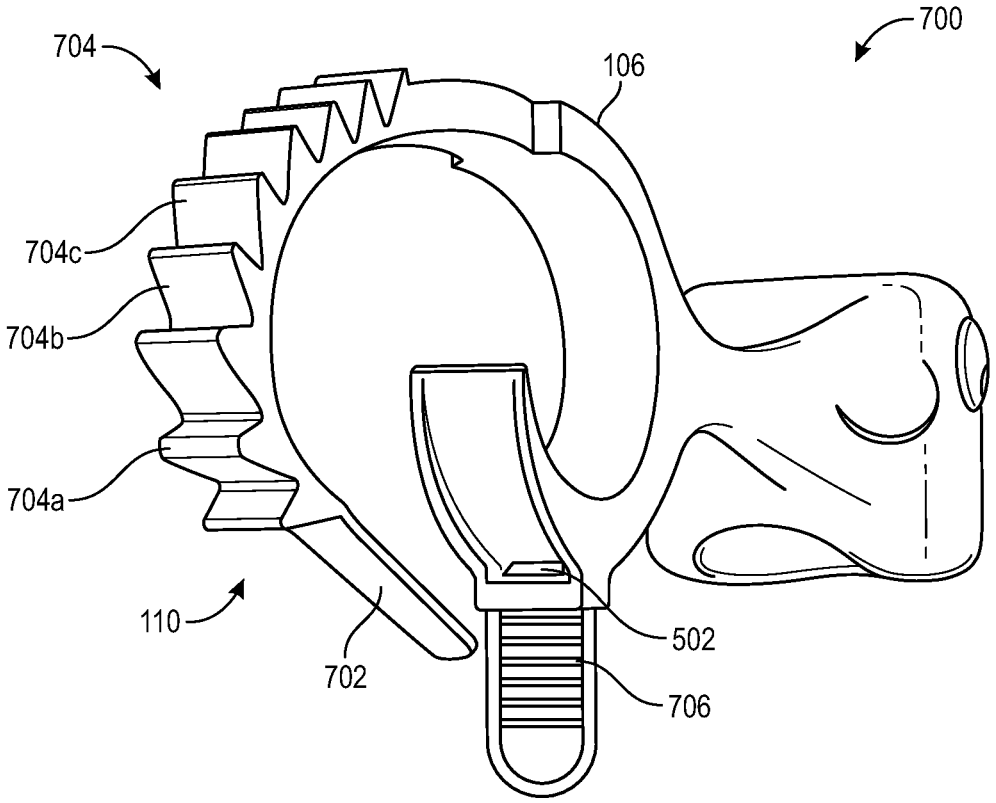
FIG. 7 is a rear perspective view of the device in accordance with another preferred embodiment of the present invention.

FIG. 7 is a rear perspective view of the device 700 in accordance with another preferred embodiment of the present invention. The one or more connecting body 110 further includes a self-locking zip tie strap 702 configured to be pulled by the operator and plurality of teeth 704 such as 704*a*, 704*b*, 704*c* configured on the self-locking zip tie strap 702.

The operator pulls the self-locking zip tie strap 702 through the hollow unit 502. The self-locking zip tie strap 702 secures between the teeth 704 to attach the gripping body 106 to the shank of the doorknob. The teeth 704, wherein each tooth such as 704*a*, 704*b*, 704*c* engages itself in the hollow unit 502 as it is pulled through the hollow unit 502.

In another preferred embodiment of the present invention, the one or more connecting body 110 further includes a pinch tab 706 configured below the hollow unit 502. The pinch tab 706 allows the operator to pull to increase the size of the opening of the hollow unit 502. Thus allowing the operator to remove the self-locking zip tie strap 702 through the hollow unit 502 to the desired tightness. Further, the pinch tab 706 allows the operator to create a counter force after inserting the self-locking zip tie strap 702 through the hollow unit 502 to tighten the gripping body 106 around the shank.

Figure 8:
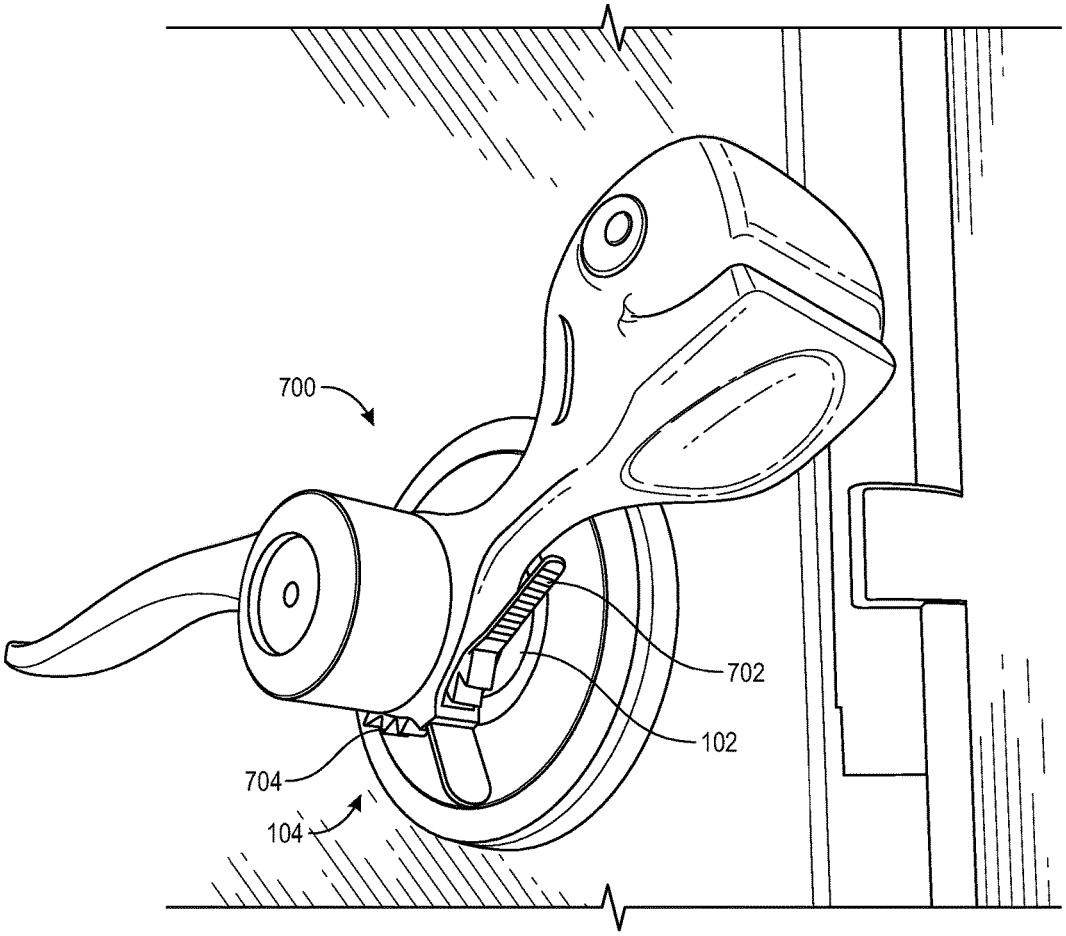
FIG. 8 illustrates another perspective view of the device attached to the shank of the doorknob in accordance with another preferred embodiment of the present invention.

FIG. 8 illustrates another perspective view of the device 700 attached to the shank 102 of the doorknob 104. The operator is able to secure the gripping body on the shank 102 by pulling the self-locking zip tie strap 702 and engaging the teeth 704 until the gripping body is tightened around the shank. It would be readily apparent to those skilled in the art that various shapes and sizes of self-locking zip tie strap 702 and teeth 704 may be envisioned without deviating from the scope of the present invention.

The present invention offers various advantages. The present invention is easy to install, it remains installed at all times when needed, it allows the doorknob to be operated normally to open or close the door, and it is easy for an adult, but not for a small child to remove when not needed. The present invention may protect children, pets, or adults from door slam injuries.

Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A device attached to a shank of a doorknob for protecting fingers of a person from getting impinged in between a door and a doorframe during closing of the door by an operator, the device comprising:

a gripping body having a distal end and a front end, the distal end configured to wrap around the shank of the doorknob;

a bumper body having a rear end and a bumper end, the rear end attached to the front end of the gripping body and the bumper end configured for preventing closing of the door;

a hollow unit positioned between the bumper body and the gripping body; and one or more connecting body to pass through the hollow unit to attach the gripping body to the shank of the doorknob, the one or more connecting body comprising:

a self-locking zip tie strap configured to be pulled by the operator;

plurality of teeth configured on the self-locking zip tie strap;

wherein the operator pulls the self-locking zip tie strap through the hollow unit; the teeth engages the teeth until the gripping body is tightened around the shank.

2. The device according to claim 1 further comprising:

a receptacle unit configured in the bumper body; and a message holder secured in the receptacle unit, further the message holder displays a message, wherein the message is interchangeable.

3. The device according to claim 1 wherein the rear end of the bumper body is configured to detachably attach with the front end of the gripping body.

4. The device according to claim 1 wherein the bumper body is configured of a flexible material, wherein the bumper body bends to allow the door knob to return to a neutral position allowing the door to latch.

5. The device according to claim 1 wherein the connecting body further comprising a pinch tab for allowing the operator to create a counter-force after inserting the self-locking zip tie strap through the hollow unit to achieve the desired tightness.

6. The device according to claim 5 wherein the pinch tab further allows the operator to increase the size of the hollow unit to disengage the teeth of the zip tie strap in order to remove the device from the doorknob.

7. A device attached to a shank of a doorknob for protecting fingers of a person from getting impinged in between a door and a doorframe during closing of the door by an operator, the device comprising:

a gripping body having a distal end and a front end, the distal end configured to wrap around the shank of the doorknob;

a bumper body having a rear end and a bumper end, the rear end attached to the front end of the gripping body and the bumper end configured for preventing closing of the door;

a hollow unit positioned between the bumper body and the gripping body; and one or more connecting body to pass through the hollow unit to attach the gripping body to the shank of the doorknob, the one or more connecting body comprising:

plurality of adhesive units attached to sides of the gripping body;

a first hook and loop fastener strap having a first front end and a first back end, the first front end attached to one side of said gripping body through at least one of the adhesive units; and a second hook and loop fastener strap having a second front end and a second back end, the second end attached to another side of the gripping body through at least one of the adhesive units, the second back end rotates around the shank of the doorknob to secure with the second back end.

8. The bumper body according to claim 7 further comprising:

a receptacle unit configured in the bumper body; and a message holder secured in the receptacle unit, further the message holder displays a message, wherein the message is interchangeable.

9. The device according to claim 7 wherein the rear end of the bumper body is configured to detachably attach with the front end of the gripping body.

10. The device according to claim 7 wherein the bumper body is configured of a flexible material, wherein the bumper body bends to allow the door knob to return to a neutral position allowing the door to latch.

11. A device attached to a shank of a doorknob for protecting fingers of a person from getting impinged in between a door and a doorframe during closing of the door by an operator, the device comprising:

a gripping body having a distal end and a front end, the distal end configured to wrap around the shank of the doorknob;

a bumper body having a rear end and a bumper end, the rear end attached to the front end of the gripping body and the bumper end configured for preventing closing of the door;

a hollow unit positioned between the bumper body and the gripping body; and one or more connecting body to pass through the hollow unit to attach the gripping body to the shank of the doorknob, the one or more connecting body comprising:

a hook and loop fastener strap having a first end and a back end, the first end inserted through the hollow unit and around the shank of the doorknob; and a hook unit attached to the back end of the hook and loop fastener strap;

wherein the first end is detachably attached to the hook unit resulting in the fixation of the gripping body with the shank of the doorknob.

12. The bumper body according to claim 11 further comprising:

a receptacle unit configured in the bumper body; and a message holder secured in the receptacle unit, further the message holder displays a message, wherein the message is interchangeable.

13. The device according to claim 11 wherein the rear end of the bumper body is configured to detachably attach with the front end of the gripping body.

14. The device according to claim 11 wherein the bumper body is configured of a flexible material, wherein the bumper body bends to allow the door knob to return to a neutral position allowing the door to latch.

* * * * *